US007439660B2

(12) United States Patent
Pollmann-Retsch et al.

(10) Patent No.: US 7,439,660 B2
(45) Date of Patent: Oct. 21, 2008

(54) DISCHARGE LAMP HAVING COOLING MEANS

(75) Inventors: Jens Pollmann-Retsch, Aachen (DE); Holger Moench, Vaals (NL); Wouter Jozef Maes, Zwijndrecht (BE); Edmond Mariette E Verstraeten, Geel (BE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 97 days.

(21) Appl. No.: 10/520,804

(22) PCT Filed: Jul. 3, 2003

(86) PCT No.: PCT/IB03/02631

§ 371 (c)(1),
(2), (4) Date: Jan. 10, 2005

(87) PCT Pub. No.: WO2004/008482

PCT Pub. Date: Jan. 22, 2004

(65) Prior Publication Data

US 2006/0001340 A1 Jan. 5, 2006

(30) Foreign Application Priority Data

Jul. 11, 2002 (DE) ..... 102 31 258

(51) Int. Cl.
*H01J 7/26* (2006.01)
*H01J 61/52* (2006.01)
*H01J 11/00* (2006.01)
*H01K 1/58* (2006.01)

(52) U.S. Cl. ..... 313/35; 313/11; 313/36; 313/567; 313/17; 313/22; 313/24

(58) Field of Classification Search ..... 313/35

See application file for complete search history.

(56) References Cited

U.S. PATENT DOCUMENTS 3,843,879 A 10/1974 Eddy ..... 240/47

(Continued)

FOREIGN PATENT DOCUMENTS

DE 3318795 12/1983

(Continued)

OTHER PUBLICATIONS

Certified English translation of JP 05-054862 (Sakugi).*

(Continued)

*Primary Examiner*—Sikha Roy
*Assistant Examiner*—Natalie K Walford

(57) ABSTRACT

A discharge lamp, and particularly a high-pressure gas-discharge lamp (an HID (high-intensity discharge) lamp or UHP (ultra-high performance) lamp), having a reflector and a cooling means is described. The cooling means comprises at least one nozzle (3) by which a flow of gas can be directed onto the discharge lamp, the at least one nozzle (3) being so arranged that it does not extend, at least to any substantial degree, into a beam path produced by the lamp (2) and the reflector (1). In this way, the cooling means does not produce any obstacles on the beam path for the light. With preferred embodiments, it is possible to produce a turbulent flow that surrounds particularly the discharge vessel (21) of the lamp and that considerably increases the effectiveness of the cooling means. Further embodiments also allow the discharge lamp to be operated in a plurality of different positions without individual regions of the lamp being too little or too severely cooled.

13 Claims, 2 Drawing Sheets

U.S. PATENT DOCUMENTS

| | | | | |
|---|---|---|---|---|
| 4,405,882 | A | | 9/1983 | Reinsch |
| 4,695,757 | A | | 9/1987 | Ury et al. |
| 6,016,031 | A | * | 1/2000 | Lapatovich et al. ..... 313/35 |

FOREIGN PATENT DOCUMENTS

| | | | | |
|---|---|---|---|---|
| JP | 05054862 | | | 3/1993 |
| JP | 05054862 | A | * | 3/1993 |
| JP | 09147805 | | | 10/1997 |
| JP | 10125287 | | * | 5/1998 |
| JP | 10125287 | | | 8/1998 |
| JP | 2001135134 | | | 3/2001 |

OTHER PUBLICATIONS

Certified English translation of JP 10-125287 (Kaneko et al.).*

* cited by examiner

DISCHARGE LAMP HAVING COOLING MEANS

The invention relates to a discharge lamp, and particularly to a high-pressure gas-discharge lamp (an HID (high-intensity discharge) lamp or UHP (ultra-high performance) lamp), having a reflector and a cooling means.

Depending on their size, their installed situation and the power at which they are operated, discharge lamps are exposed to a relatively high level of thermal stress. To avoid any shortening of their life that may occur as a result of this and/or to enable the power of the discharge lamp to be further increased, a cooling means is used in many cases.

Known from U.S. Pat. No. 3,843,879 for example is a discharge lamp that is fitted into the neck of a reflector by one of its electrode seals (pinches). A cooling means is formed in this case essentially by a sleeve arrangement that is connected to a source of compressed air and is mounted on the other electrode seal of the lamp and through which a flow of air is directed onto the lamp. A major disadvantage of this cooling means is, however, that the optical properties of the lamp are adversely affected by the sleeve arrangement and the ducts required to feed in the compressed air as a result of light being screened off or the light distribution polar diagram being altered.

Also, problems may arise with this and other cooling means when the lamp is not operated in its intended operating position, because any change in this position also means on the one hand that the hottest regions of the lamp are shifted to different points and may then possibly not be adequately cooled, in which case there is then a risk of the quartz of the lamp envelope recrystallizing. On the other hand, there may be other regions that are too severely cooled, so that the discharge gas condenses at them and the gas pressure in the lamp drops.

It is therefore an object of the invention to provide a discharge lamp having a reflector and a cooling means that do not cause any screening off that will have any adverse effect worth mentioning on the light yield or the light distribution polar diagram.

It is also an aim of the invention to provide a discharge lamp having a reflector and a cooling means of greater effectiveness, thus enabling the power, efficiency and light yield of the lamp to be increased without any fear of its life being shortened to any substantial extent as a result.

Finally, the invention is also intended to provide a lamp having a reflector and an improved cooling means, with which cooling means cooling that is optimum and largely independent of the operating position of the lamp can be obtained, which means that individual regions of the lamp are cooled neither too severely nor too gently.

The object is achieved in the manner claimed in claim 1 by a discharge lamp having a reflector and a cooling means, in which the cooling means has at least one nozzle by which a flow of gas can be directed onto the discharge lamp, the at least one nozzle being so arranged that it does not extend, at least to any substantial degree, into a beam path produced by the lamp and the reflector.

What is meant by "any substantial degree" in this case is a degree such that the emitted light and/or the light distribution polar diagram of the lamp are respectively reduced and/or adversely affected in a manner that is detectable in the relevant application. However, in the ideal case the nozzle does not extend into the beam path at all.

An advantage of this solution is the fact that other parts of the cooling means, such for example as feed ducts, mountings, etc., do not form obstacles in the beam path of the light generated so that, in contrast to known designs, neither the light yield nor the light distribution polar diagram is adversely affected by screening off.

With the present cooling means it is also possible for certain regions of the lamp to be targeted for more severe cooling than other regions, which means that the power of the lamp can be increased for an equal life (or its life can be increased for the same power).

Finally, the cooling means can be fitted in a way that is largely independent of the fitting of the lamp into the reflector, nor are any costly and complicated adjustments required.

The dependent claims relate to advantageous refinements of the invention.

The embodiment dealt with in claim 2 enables the nozzle(s) to be fitted in a particularly easy way without any costly mounting means or the like being required.

The embodiments dealt with in claims 3 to 5 produce a turbulent flow that surrounds at least part of the lamp and by which the efficiency of the cooling means is further improved.

With the embodiment dealt with in claim 6, it is possible for the operation of the cooling means to be monitored and, in the event of a fault, for the lamp to be switched off in good time before it destroys itself.

With the embodiments dealt with in claims 7 to 9, it is possible for the lamp to be operated in various operating positions without there being any danger of the regions of the discharge vessel that are at the top in the given position being too severely heated or the regions that are at the bottom being too severely cooled.

The embodiments dealt with in claims 8 and 9 enable the cooling to be automatically and optimally adapted to the operating position of the lamp.

These and other aspects of the invention are apparent from and will be elucidated with reference to the embodiments described hereinafter.

Figure 1:
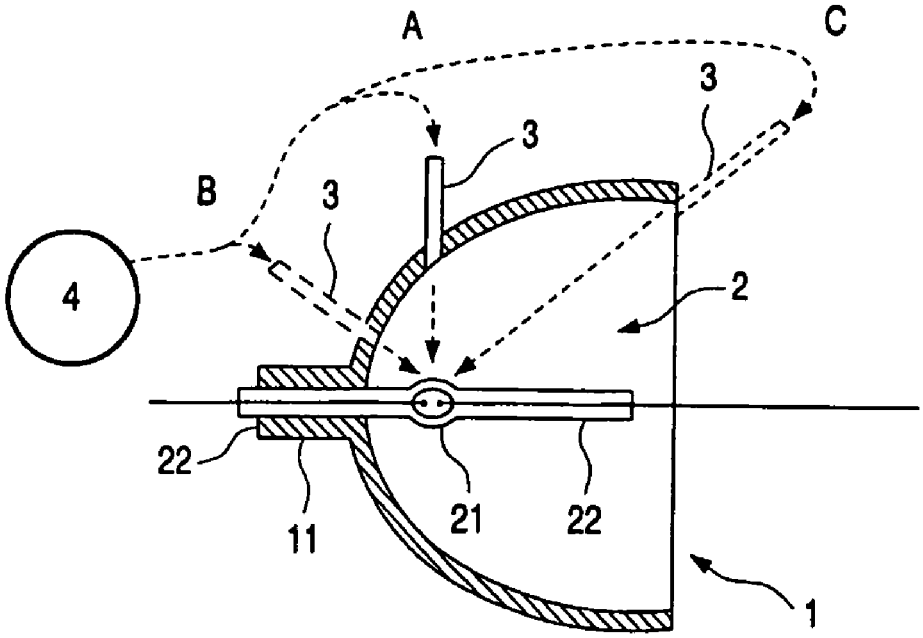
FIG. 1 is a longitudinal section through a lamp assembly forming a first embodiment.

FIG. 1 is a diagrammatic view of a first embodiment of the invention in the form of a combination of a reflector I with a discharge lamp 2 and a cooling means. The discharge lamp is preferably a high-pressure gas-discharge lamp (an HID or UHP lamp) that has a discharge vessel 21 and metal-to-quartz seals 22. The lamp 2 is mounted in the neck 11 of the reflector in the region of one of its metal-to-quartz seals 22.

The discharge vessel 21 seals off a discharge chamber containing a discharge gas. When the lamp is in a state of operation, an arc discharge is excited between the opposing tips of electrodes that extend in a known manner into the discharge chamber.

The discharge lamp 2 is so positioned that the arc discharge (light-generating arc) is situated substantially at the focal point of the reflector 1 and the lamp is given a beam path (light distribution polar diagram) that corresponds to the shape of the reflector.

As shown in FIG. 1, the cooling means comprises at least one nozzle 3 that is shown in three illustrative positions A, B, C, and at least one source 4 of gas pressure that is connected to the nozzle 3 for the infeed of gas and preferably air. The source 4 of gas pressure is preferably formed by a positive displacement pump by which air is pumped through the nozzle 3.

The nozzle 3 is fitted in such a way that it is directed substantially at the region of the discharge vessel 21 that it is its upper region when the lamp is in its intended operating position. To enable the nozzle 3 to be fitted at the positions A and/or B in which it is perpendicular above the discharge vessel 21 and/or in the region of the neck 11 of the reflector, respective holes are therefore bored in the reflector, into which the nozzle 3 is fitted. A suitable mounting (not shown) is used to fit the nozzle 3 in position and align it at the position C situated at the opening of the reflector.

The nozzle 3 has no need in this case to extend into the beam path of the light generated (i.e. into the interior of the reflector I in the case of positions A and B). Depending on how deeply the nozzle 3 is inserted into the relevant hole or, in position C, is lowered, so does at most its tip (outlet opening) intrude into the beam path.

A major advantage of this arrangement is thus the fact that the light loss caused by the cooling means is extremely small and in the case of positions A and B is determined solely by the cross-section of the holes made in the respective cases for the nozzle 3 in the reflector 1. Because the other parts of the cooling means are situated outside the reflector 1 and the beam path of the light generated, there is no screening off or scattering of the light.

The additional cooling means also hardly impedes the assembly of the lamp or has any adverse effect on it. The nozzle 3 can be fitted independently of the fitting of the discharge lamp 2 into the reflector 1, in which case there is also no need for any complicated and expensive lining up between the lamp 2 and the nozzle 3.

The diameter of the nozzle 3 (the outlet opening for the gas) and the output of the source 4 of gas pressure are matched to one another in such a way that the gas emerges from the nozzle 3 at a relatively high velocity. The nozzle 3 is preferably of a relatively small diameter (approximately 0.5 to 2 mm for example) in this case compared with known cooling means, which means that, due to the smaller diameter of the relevant hole in the reflector, the light losses are so small that they can be ignored. The source 4 of gas pressure is so designed that it is able to produce a gas pressure that is sufficiently high (several 100 mbars for example) for the pressure drop in the nozzle 3.

To increase the efficiency of the cooling, the velocity at which the gas emerges from the nozzle 3 should preferably be sufficiently high for no boundary layer surrounding the discharge vessel 21 to be formed or for any such layer, which will have the effect of thermally insulating the discharge vessel 21, to be penetrated and at least largely destroyed by the flow of gas emerging from the nozzle 3, thus producing a turbulent flow that at least partly surrounds the discharge vessel 21.

Surprisingly, it has been found that very effective and efficient cooling is obtained in this way. The wall of the discharge vessel 21 can be cooled in this way to appreciably below the temperature at which there is any fear of the quartz recrystallizing.

If a plurality of nozzles of the kind shown in FIG. 1 are arranged in a distributed fashion along the circumference of the reflector (position A and/or B) and of the reflector opening (position C) and are each directed at a region of the discharge vessel 21 situated opposite them, these regions can be cooled to different degrees by different flows of gas.

This also makes it possible for the lamp to be operated in different operating positions, and in particular when rotated to different positions about the longitudinal axis of the reflector 1, if, as a function thereof, the gas flows fed to the nozzles 3 are suitably varied in such a way that the regions of the discharge vessel 21 that are at the top at the time are cooled sufficiently severely by an increased supply of gas to the nozzle(s) directed at them, and the other regions, and particularly the regions that are situated at the bottom, are not too severely cooled as a result of a suitably throttled supply of gas to the nozzle(s) directed at these regions or as a result of this gas supply being switched off entirely.

In this first embodiment, the efficiency of the cooling can be further improved by making even the gas flow that emerges from the nozzle 3 or acts on the discharge vessel 21 turbulent. For this purpose, turbulence in the flow can be obtained on the one hand by increasing the gas pressure produced by the source 4 of gas pressure and the velocity of flow that is related to this pressure. On the other hand, a turbulent flow can also be obtained by means of baffles or similar structure in the region of the discharge vessel 21, although this is not a path that will generally be followed due to the screening off of the light that it involves.

Figure 2:
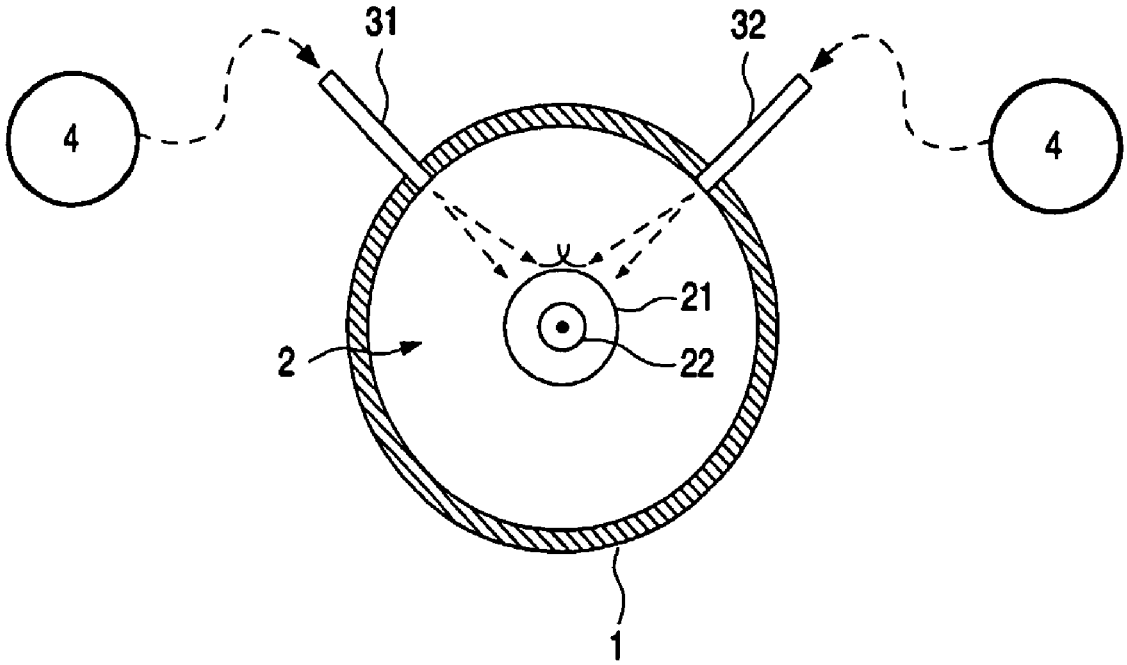
FIG. 2 is a cross-section through a second embodiment of the invention.

A third possible way of obtaining or increasing turbulence in the flow is afforded by the second embodiment shown in FIG. 2. FIG. 2 is a cross-section through a reflector 1 looking in the direction of the discharge lamp 2. In this embodiment, there is not only a main flow of the kind described above that is directed into the reflector 1 but also at least one further auxiliary flow, the arrangement preferably being such that the (or all the) flows meet in the region above the discharge vessel 21. This make the originally laminar main flow turbulent.

For this purpose, the second embodiment has at least one first and at least one second nozzle 31, 32 that, as in the first embodiment, are each inserted in a hole made in the reflector 1. The nozzles 31, 32 are directed in this case onto the region above the discharge vessel 21 at an angle of approximately 90° to one another, which means that the two flows meet there and produce a turbulent flow of gas. There is no need in this case for there to be any difference between the main and auxiliary flows. Rather, two substantially identical gas flows may be generated, even for example by a common source 4 of gas pressure with a suitable branched duct. Otherwise, this embodiment is the same as that shown in FIG. 1.

An advantage that this second embodiment has over an increase in the pressure of the gas as described above is that there is no need for an increase in the overall volume of gas flowing into the reflector per unit of time or, if an increase is needed, it is only a minor one.

Due to the higher coefficient of transfer of a turbulent flow as compared with a laminar one, the efficiency with which the lamp is cooled is further improved. However, at the same time, due to the fact of a highly directed flow being obtained as explained above, there need be no fear that, the colder regions of the lamp 2 and in particular of the discharge vessel 21 will be too severely cooled, which means that it will also not be possible for any excessive condensation of the discharge gas to take place on the wall regions concerned.

Figure 3:
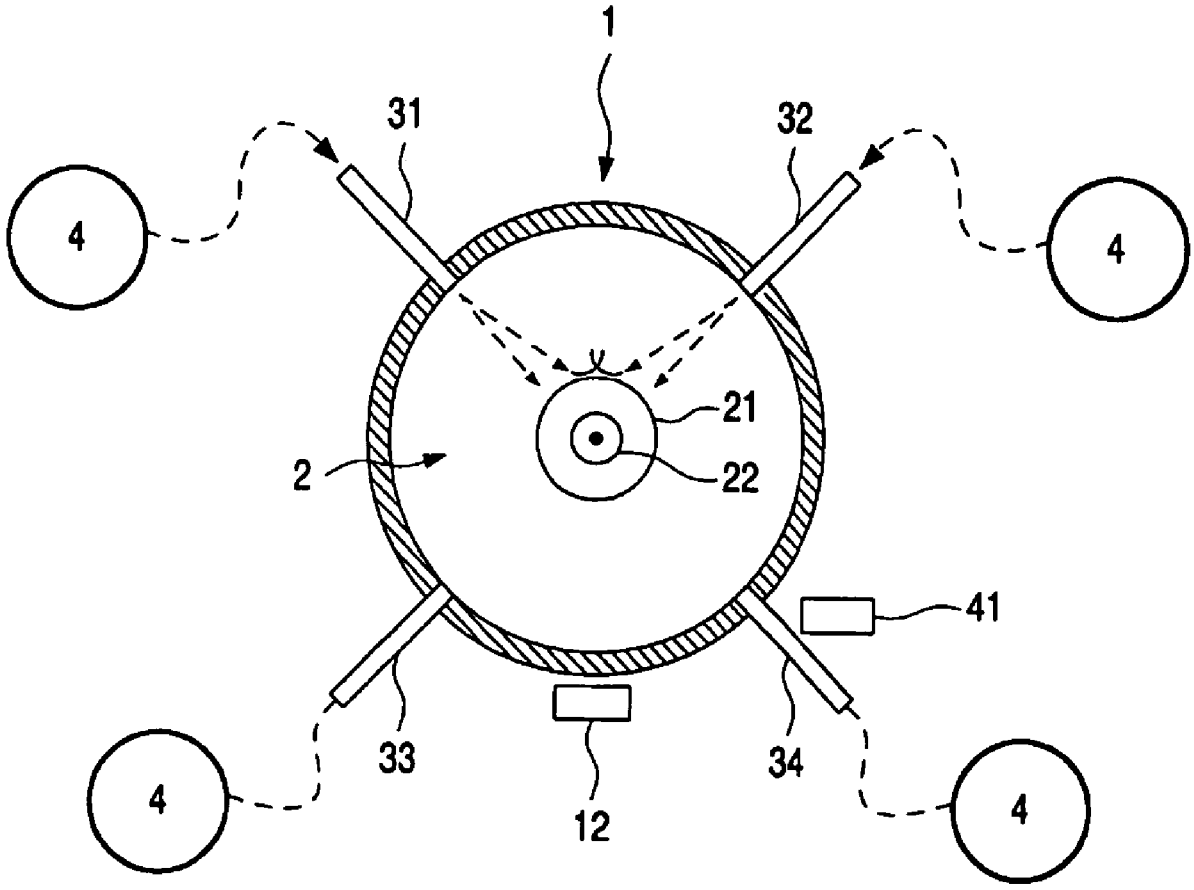
FIG. 3 is a cross-section through a third embodiment of the invention.

FIG. 3 shows a third embodiment of the invention, one again in the form of a cross-section though a reflector 1 looking in the direction of a discharge lamp 2. In this case, the cooling means comprises, in addition to a first and a second nozzle 31, 32 as in the second embodiment, a third and a fourth nozzle 33, 34, which nozzles are likewise at an angle of approximately 90° to one another but are directed onto a region below the discharge vessel 21 of the lamp 2. With this cooling means, the lamp can be cooled with a turbulent flow of gas from different directions, in which case further nozzles may be provided in addition to the four 31, 32, 33, 34 shown in FIG. 3. Otherwise, this embodiment is the same as that shown in FIG. 1.

To supply gas pressure to the nozzles 3; 31,32, 33, 34, a source 4 of gas pressure may be provided for each nozzle, or one or more of the nozzles 3; 31, 32,33, 34 may be fed from a common source 4 of gas pressure. Suitable branched ducts will be provided in the latter case.

The same is also true of the setting or control of the gas pressure. On the one hand, the sources 4 of gas pressure used may each be controllable independently of one another to produce a desired gas pressure, or on the other a valve for controlling gas pressure may be arranged downstream of a branch off from the duct to enable an appropriate reduction to be made in the pressure of the gas flow emerging from the nozzle concerned.

Alternatively, is it also possible for one or more branched ducts to be so designed that the ratio between the volumes of gas distributed to the branches can be set. For this purpose, use may likewise be made, in a known fashion, of valves or the like.

To achieve a very accurate distribution of the volumes to gas to the individual nozzles and to allow the volumes to be controlled, independent flow-controlling devices may be provided in each supply duct leading to a nozzle or at the nozzle itself. To sense the velocity of the flow of gas emerging from the nozzle(s) 3; 31, 32, 33, 34 use may be made in each case of a first sensor 41, such as a temperature sensor for example, that is mounted on the nozzle(s) concerned. In this case, the nozzle in question must be thermally insulated from other parts of the lamp system that have a high thermally effective mass, such as the reflector 1, for example. Due to its substantially smaller thermally effective mass, the temperature of the nozzle will then follow any change in the state of cooling substantially faster than will the temperature of the lamp 2 or the reflector 1.

A temperature sensor of this kind can also be used to sense faults in the cooling means and in its general state of operation. If, for example, a source 4 of gas pressure fails and the temperature sensed by the relevant first sensor 41 exceeds a preset maximum value, the lamp 2 can be switched off in good time before it is damaged. It may also be useful, before the lamp 2 is switched on, for a check to be made by analyzing the signal from the first sensor 41 to see whether a flow of gas is emerging from the nozzle concerned and whether the source 4 of gas pressure is operating in the intended way.

Rather than a temperature sensor, a first sensor 41 of some other kind may also be used to sense the flow of gas emerging from a nozzle. What may also be considered for this purpose are, for example, pressure sensors, which measure the pressure drop at the nozzle, or other sensors by which a gas flow or the flow-rate of the flow is sensed.

Optimum cooling that is independent of the position in which the lamp is operating can be achieved with the third embodiment shown in FIG. 3, in that both those regions of the discharge vessel 21 that are situated at the top in the given position and that are particularly severely heated as a result of thermal convection are adequately cooled by two or more nozzles 31, 32 directed at them, to which a suitable flow of gas is fed, and also the regions situated at the bottom in the given position are not too severely cooled, by suitably throttling or switching off the flow of gas to the two or more nozzles 33, 34 directed at them.

The third embodiment shown in FIG. 3 can thus assume at least two operating positions that are each rotated through 180° about the longitudinal axis of the reflector 1 from the position shown in FIG. 3, so that two nozzles 31, 32; 33, 34 are always directed at the upper region of the discharge vessel 21, each at an angle of approximately 45° to the vertical direction. The two nozzles in question in each case form a nozzle pair through which a turbulent flow of gas as described above is trained onto the upper region from the at least one source 4 of gas pressure. If each nozzle 31, 32, 33, 34 were controlled independently and were operated in combination with an adjacent nozzle as a nozzle pair, this embodiment could even assume four operating positions that were each rotated through 90° about the longitudinal axis of the reflector 1.

To allow intermediate positions to be assumed, the regions of the discharge vessel 21 or of the lamp 2 that are at the top in the given position will be cooled by an appropriate distribution of the gas flows fed to the relevant nozzles directed at these regions.

If there are a larger number of independently controllable nozzles, the lamp may also be intended for a correspondingly larger number of operating positions.

To allow the cooling means to be controlled as a function of the operating position of the lamp, a second sensor 12 is preferably provided to sense the operating position of the lamp at the time. This may be a known attitude switch (such as a mercury switch for example) having an appropriate number of contacts. If the lamp is used in a projector that can be operated in a number of positions, then a suitable attitude signal may also be generated by the projector. Finally, the cooling means may also be controlled by means of a switch that is operated by a user as a function of the position in which the lamp is operating.

If the reflectors used are ones which are, for example, oval or of a non-symmetrical shape in cross-section, the gas flows fed to the individual nozzles may also be set as a function of the distance between the relevant nozzle and the lamp 2 or discharge vessel 21 and, if required, may be weighted by a factor determined as a function of the operating position of the lamp.

To allow the different velocities of flow described above to be obtained at the nozzles 3, 31, 32, 33, 34 as a function of the operating position of the lamp 2 and of the cooling demand or the signals from the sensors 41; 12, the sources 4 of gas pressure or suitable valves in branches off from the ducts are controlled, by the signals from the sensors for example, in a manner known per se, thus making any further explanation here unnecessary.

Generally speaking, when a plurality of nozzles are arranged in accordance with the invention along the circumference of the reflector 1, the following further advantage is obtained:

High-pressure gas-discharge lamps (and particularly HID lamps) of particularly high power can be used that require cooling on all sides, that is to say cooling of the coldest regions too. In this case, a uniform temperature can be obtained at all the regions of the discharge vessel by feeding to the nozzles flows of gas that are each of an intensity suited to the local cooling demand.

The invention claimed is:

1. A discharge lamp having a reflector and cooling means, which cooling means has at least one nozzle (3; 31, 32, 33, 34) through which a flow of gas can be directed onto the discharge lamp, wherein the at least one nozzle (3; 31, 32, 33, 34) is arranged such that it does not extend, at least to any substantial degree, into a beam path produced by the lamp (2) and the reflector (1) wherein no part of the cooling means is located inside a cavity formed by the reflector.

2. A discharge lamp as claimed in claim 1, wherein the at least one nozzle (3; 31, 32, 33, 34) is inserted in a hole in the reflector (1).

3. A discharge lamp as claimed in claim 1, wherein a velocity of the flow of gas emerging from the at least one nozzle (3, 31, 32, 33, 34) is of a value such that a turbulent flow is produced that surrounds at least part of the lamp (2).

4. A discharge lamp as claimed in claim 1, wherein at least two nozzles (31, 32; 33, 34) that are at an angle to one another are directed at the discharge lamp (2) such that a turbulent flow is produced that surrounds at least part of the lamp (2).

5. A discharge lamp as claimed in claim 4, wherein the nozzles (31, 32;

33, 34) are at an angle of approximately 90 ° to one another.

6. A discharge lamp having a reflector and cooling means, which cooling means has at least one nozzle (3; 31, 32, 33, 34) through which a flow of gas can be directed onto the discharge lamp, wherein the at least one nozzle (3; 31, 32, 33, 34) is arranged such that it does not extend, at least to any substantial degree, into a beam path produced by the lamp (2) and the reflector (1), wherein a first sensor (41) is arranged adjacent at least one of the nozzles (3; 31, 32, 33, 34) to sense the velocity and/or the pressure and/or the flow-rate of a flow of gas passing through the nozzle (3; 31, 32, 33, 34).

7. A discharge lamp as claimed in claim 1, wherein at least one first nozzle (31, 32) is directed at a region of a discharge vessel (21) that is at the top in the position in which the discharge lamp (2) is operating, and at least one second nozzle (33, 34) is directed at a region of the discharge vessel (21) that is at the bottom in this same operating position.

8. A discharge lamp as claimed in claim 7, wherein a velocity of the flow of gas passing through at least one of the nozzles (3; 31, 32, 33, 34) can be controlled as a function of the operating position of the discharge lamp (2).

9. A discharge lamp having a reflector and cooling means, which cooling means has at least one nozzle (3; 31, 32, 33, 34) through which a flow of gas can be directed onto the discharge lamp, wherein the at least one nozzle (3; 31, 32, 33, 34) is arranged such that it does not extend, at least to any substantial degree, into a beam path produced by the lamp (2) and the reflector (1), wherein at least one first nozzle (31, 32) is directed at a region of a discharge vessel (21) that is at the top in the position in which the discharge lamp (2) is operating, and at least one second nozzle (33, 34) is directed at a region of the discharge vessel (21) that is at the bottom in this same operating position, wherein a second sensor (12) is provided to sense the operating position of the discharge lamp (2) and to control the velocity of the flow of gas passing through at least one of the nozzles (3; 31, 32, 33, 34) as a function of the operating position.

10. A discharge lamp comprising a reflector;

a discharge vessel for emitting light onto the reflector, thereby creating a beam path;

cooling means for adquately cooling an upper region of the lamp, while a bottom region is not too severely cooled, in a position independent fashion, the cooling means comprising at least first and second independently controllable nozzles for directing a flow of gas into the lamp, the nozzles being arranged such that they do not extend, at least to any substantial degree, into the beam path, and so that an upper region of the lamp is adequately cooled, while a bottom region is not too severely cooled;

at least one first sensor for measuring a cooling effect of the nozzles; and at least one second sensor for detecting an operation position of the lamp.

11. The discharge lamp of claim 3, wherein the flow of gas is not pulsed.

12. The discharge lamp of claim 8, wherein control of the flow as a function of position occurs automatically responsive to sensed position.

13. The discharge lamp of claim 7, wherein the flow is adapted for non-uniform cooling so that a top portion of the discharge vessel is cooled more than a bottom portion.

* * * * *